US010017861B2

(12) United States Patent
Silvernail et al.

(10) Patent No.: US 10,017,861 B2
(45) Date of Patent: Jul. 10, 2018

(54) ZIRCONIUM PRETREATMENT COMPOSITIONS CONTAINING A RARE EARTH METAL, ASSOCIATED METHODS FOR TREATING METAL SUBSTRATES, AND RELATED COATED METAL SUBSTRATES

(75) Inventors: Nathan J. Silvernail, Allison Park, PA (US); Mark W. McMillen, Cabot, PA (US); Shan Cheng, Sewickley, PA (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 13/197,075

(22) Filed: Aug. 3, 2011

(65) Prior Publication Data

US 2013/0034742 A1 Feb. 7, 2013

(51) Int. Cl.

| | |
|---|---|
| ***C23C 22/48*** | (2006.01) |
| ***C23C 22/50*** | (2006.01) |
| ***C23C 22/53*** | (2006.01) |
| ***C23C 22/56*** | (2006.01) |
| ***C23C 22/74*** | (2006.01) |
| ***C23C 22/83*** | (2006.01) |
| ***C25D 13/20*** | (2006.01) |

(52) U.S. Cl.

CPC ..... *C23C 22/50* (2013.01); *C23C 22/53* (2013.01); *C23C 22/56* (2013.01); *C23C 22/74* (2013.01); *C23C 22/83* (2013.01); *C25D 13/20* (2013.01); *Y10T 428/12493* (2015.01)

(58) Field of Classification Search

CPC ..... C23C 22/48
USPC ..... 148/247
See application file for complete search history.

(56) References Cited

U.S. PATENT DOCUMENTS

| | | | |
|---|---|---|---|
| 3,455,806 | A | 7/1969 | Fletcher et al. |
| 3,663,389 | A | 5/1972 | Koral et al. |
| 3,749,657 | A | 7/1973 | Christenson et al. |
| 3,793,278 | A | 2/1974 | De Bona et al. |
| 3,928,157 | A | 12/1975 | Suematsu et al. |
| 3,947,338 | A | 3/1976 | Jerabek et al. |
| 3,947,339 | A | 3/1976 | Jerabek et al. |
| 3,962,165 | A | 6/1976 | Bosso et al. |
| 3,975,346 | A | 8/1976 | Bosso et al. |
| 3,984,299 | A | 10/1976 | Jerabek |
| 3,984,922 | A | 10/1976 | Rosen |
| 4,001,101 | A | 1/1977 | Bosso et al. |
| 4,116,900 | A | 9/1978 | Belanger |
| 4,134,932 | A | 10/1979 | Kempter et al. |
| 5,868,819 | A | 2/1999 | Guhde et al. |
| 6,875,800 | B2 | 4/2005 | Vanier et al. |
| 6,894,086 | B2 | 5/2005 | Munro et al. |
| 7,438,972 | B2 | 10/2008 | Faler et al. |
| 7,605,194 | B2 | 10/2009 | Ferencz et al. |
| 8,075,708 | B2 | 12/2011 | Matsukawa et al. |
| 8,153,344 | B2 | 4/2012 | Faler et al. |
| 2004/0079647 | A1 | 4/2004 | Warburton |
| 2008/0020133 | A1 | 1/2008 | Kobori et al. |
| 2009/0032144 | A1* | 2/2009 | McMillen et al. ..... 148/247 |
| 2009/0084471 | A1* | 4/2009 | Brent ..... C23C 22/361 148/253 |
| 2009/0218228 | A1* | 9/2009 | Inbe ..... C08G 59/50 205/80 |

FOREIGN PATENT DOCUMENTS

| | | |
|---|---|---|
| DE | 2707405 | 1/1978 |
| EP | 0012463 | 6/1980 |
| EP | 1997935 | 3/2008 |
| JP | 2004353075 A | 12/2012 |
| RU | 2107746 C1 | 3/1998 |
| WO | 2009020794 | 2/2009 |
| WO | 2011153518 | 12/2011 |

* cited by examiner

*Primary Examiner* — Lois Zheng
(74) *Attorney, Agent, or Firm* — Alicia M. Passerin, Esq.

(57) ABSTRACT

Disclosed are methods for treating metal substrates that include contacting the substrate with a pretreatment composition comprising a rare earth metal and a zirconyl compound. The present invention also relates to coated substrates produced thereby and further to substrates additionally coated with an electrophoretically applied coating composition.

15 Claims, No Drawings

ZIRCONIUM PRETREATMENT COMPOSITIONS CONTAINING A RARE EARTH METAL, ASSOCIATED METHODS FOR TREATING METAL SUBSTRATES, AND RELATED COATED METAL SUBSTRATES

STATEMENT REGARDING FEDERALLY SPONSORED RESEARCH

This invention was made with Government support under Contract No. W912HQ-09-C-0038 awarded by SERDP (Strategic Environmental Research and Development Program). The United States Government may have certain rights in this invention.

FIELD OF THE INVENTION

The present invention relates to pretreatment compositions, methods for treating a metal substrate, including aluminum containing substrates and ferrous substrates, such as cold rolled steel and electrogalvanized steel. The present invention also relates to coated metal substrates.

BACKGROUND INFORMATION

The use of protective coatings on metal substrates for improved corrosion resistance and paint adhesion is common Conventional techniques for coating such substrates include techniques that involve pretreating the metal substrate with a phosphate conversion coating and chrome-containing rinses. The use of such phosphate and/or chromate-containing compositions, however, imparts environmental and health concerns.

As a result, chromate-free and/or phosphate-free pretreatment compositions have been developed. Such compositions are generally based on chemical mixtures that in some way react with the substrate surface and bind to it to form a protective layer. For example, pretreatment compositions based on a group IIIB or IVB metal compound have recently become more prevalent. Such compositions often contain a source of free fluorine, i.e., fluorine that is isolated in the pretreatment composition as opposed to fluorine that is bound to another element, such as the group IIIB or IVB metal. Free fluorine can etch the surface of the metal substrate, thereby promoting deposition of a group IIIB or IVB metal coating. Nevertheless, the corrosion resistance capability of these pretreatment compositions has generally been significantly inferior to conventional phosphate and/or chromium containing pretreatments.

As a result, it would be desirable to provide methods for treating a metal substrate that overcome at least some of the previously described drawbacks of the prior art, including the environmental drawbacks associated with the use of chromates and/or phosphates. Moreover, it would be desirable to provide methods for treating metal substrate that, in at least some cases, imparts corrosion resistance properties that are equivalent to, or even superior to, the corrosion resistance properties imparted through the use of phosphate conversion coatings. It would also be desirable to provide related coated metal substrates.

SUMMARY OF THE INVENTION

In certain respects, the present invention is directed to pretreatment compositions for treating a metal substrate. These pretreatment compositions comprise (a) a rare earth metal and (b) a zirconyl compound.

In still other respects, the present invention is directed to methods for treating a metal substrate comprising contacting the substrate with the pretreatment composition as described above.

DETAILED DESCRIPTION OF THE INVENTION

For purposes of the following detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the following specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

As previously mentioned, certain embodiments of the present invention are directed to methods for treating a metal substrate. Suitable metal substrates for use in the present invention include those that are often used in the assembly of automotive bodies, automotive parts, and other articles, such as small metal parts, including fasteners, i.e., nuts, bolts, screws, pins, nails, clips, buttons, and the like. Specific examples of suitable metal substrates include, but are not limited to, cold rolled steel, hot rolled steel, steel coated with zinc metal, zinc compounds, or zinc alloys, such as electrogalvanized steel, hot-dipped galvanized steel, galvanealed steel, and steel plated with zinc alloy. Also, aluminum alloys, aluminum plated steel and aluminum alloy plated steel substrates may be used. Other suitable non-ferrous metals include copper and magnesium, as well as alloys of these materials. Moreover, in certain embodiments, the substrate may be a bare metal substrate, such as a cut edge of a substrate that is otherwise treated and/or coated over the rest of its surface. The metal substrate treated in accordance with the methods of the present invention may be in the form of, for example, a sheet of metal or a fabricated part.

The substrate to be treated in accordance with the methods of the present invention may first be cleaned to remove grease, dirt, or other extraneous matter. This is often done by employing mild or strong alkaline cleaners, such as are commercially available and conventionally used in metal pretreatment processes. Examples of alkaline cleaners suitable for use in the present invention include Chemkleen 163, Chemkleen 177, Chemkleen 2010LP and Chemkleen 490MX, each of which are commercially available from PPG Industries, Inc. Such cleaners are often followed and/or preceded by a water rinse.

As previously indicated, certain embodiments of the present invention are directed to pretreatment compositions and associated methods treating a metal substrate that comprise contacting the metal substrate with a pretreatment composition comprising (a) a rare earth metal; and (b) a zirconyl compound. In certain embodiments, these pretreatment compositions are applied to the metal substrate without the prior application of an electropositive metal (i.e. in a one-step pretreatment process). As used herein, the term "pretreatment composition" refers to a composition that upon contact with a substrate reacts with and chemically alters the substrate surface and binds to it to form a protective layer.

Often, the pretreatment composition comprises a carrier, often an aqueous medium, so that the composition is in the form of a solution or dispersion of the rare earth metal compound and/or other pretreatment composition components in the carrier. In these embodiments, the solution or dispersion may be brought into contact with the substrate by any of a variety of known techniques, such as dipping or immersion, spraying, intermittent spraying, dipping followed by spraying, spraying followed by dipping, brushing, or roll-coating. In certain embodiments, the solution or dispersion when applied to the metal substrate is at a temperature ranging from 60 to 150° F. (15 to 65° C.). The contact time is often from 10 seconds to five minutes, such as 30 seconds to 2 minutes.

As defined by IUPAC and used herein, the term "rare earth metal" refers to seventeen chemical elements in the periodic table that includes the fifteen lanthanoids (the fifteen elements with atomic numbers 57 through 71, from lanthanum to lutetium) plus scandium and yttrium. Where applicable, the metal itself may be used. In certain embodiments, a rare earth metal compound is used as the source of the rare earth metal. As used herein, the term "rare earth metal compound" refers to compounds that include at least one element that is a rare earth element as defined above.

In certain embodiments, the rare earth metal compound used in the pretreatment composition is a compound of yttrium, cerium, praseodynium, or a mixture thereof. Exemplary compounds that may be used include praseodynium chloride, praseodynium nitrate, praseodynium sulfate, cerium chloride, cerium nitrate, cerium sulfate, cerous nitrate, yttrium chloride, yttrium nitrate, yttrium sulfate.

In certain embodiments, the rare earth metal compound is included in the pretreatment composition in an amount of at least 10 ppm metal, such as at least 100 ppm metal, or, in some cases, at least 150 ppm metal (measured as elemental metal). In certain embodiments, the rare earth metal compound is included in the pretreatment composition in an amount of no more than 5000 ppm metal, such as no more than 300 ppm metal, or, in some cases, no more than 250 ppm metal (measured as elemental metal). The amount of rare earth metal in the pretreatment composition can range between any of the recited values inclusive of the recited values.

As noted above, the pretreatment composition also comprises a zirconyl compound. A zirconyl compound, or zirconium oxy compound, as defined herein, refers to a chemical compound having a zirconyl group (ZrO).

In certain embodiments, the zirconyl compound in the pretreatment composition comprises zirconyl nitrate ($ZrO(NO_3)_2$), zirconyl acetate ($ZrO(C_2H_3O_2)_2$), zirconyl carbonate ($ZrOCO_3$), protonated zirconium basic carbonate ($Zr_2(OH)_2CO_3$), zirconyl sulfate ($ZrOSO_4)_2$), zirconyl chloride ($ZrO(Cl)_2$), zirconyl iodide ($ZrO(I)_2$), zirconyl bromide ($ZrO(Br)_2$), or a mixture thereof.

In certain embodiments, the ratio of zirconium (from the zirconyl compound or compounds) to rare earth metal (from the rare earth metal or rare earth metal compound or compounds) in the composition is between 200/1 and 1/1, such as between 100/1 and 2/1, or, in certain embodiments, the ratio is between 30/1 and 10/1, such as 20/1.

In certain embodiments, the amount of zirconium the zirconyl compound is included in the pretreatment composition in an amount of at least 10 ppm zirconium, such as at least 100 ppm zirconium, or, in some cases, at least 150 ppm zirconium (measured on elemental zirconium). In certain embodiments, the amount of zirconium from the zirconyl compound is included in the pretreatment composition in an amount of no more than 5000 ppm zirconium, such as no more than 300 ppm zirconium, or, in some cases, no more than 250 ppm zirconium (measured on elemental zirconium). The amount of zirconium from the zirconyl compound in the pretreatment composition can range between any combination of the recited values inclusive of the recited values.

In certain embodiments, the pretreatment composition also includes a group IVB and/or group VB metal. As used herein, the term "group IVB and/or group VB metal" refers to an element that is in group IVB or group VB of the CAS Periodic Table of Elements as is shown, for example, in the Handbook of Chemistry and Physics, 68th edition (1987), or a mixture of two or more of such elements. Where applicable, the metal itself may be used. In certain embodiments, a group IVB and/or a group VB metal compound is used. As used herein, when it is stated that the composition includes "a group IVB and/or a group VB metal compound" it means the composition includes at least one element that is in the group IVB or group VB of the CAS Periodic Table of Elements or mixture of two or more of such metals.

In certain embodiments, the group IVB and/or group VB metal compound is used in the pretreatment composition is a compound of zirconium, titanium, hafnium, or a mixture thereof. Suitable compounds of zirconium include, but are not limited to, hexafluorozirconic acid, alkali metal and ammonium salts thereof, ammonium zirconium carbonate, zirconyl nitrate, zirconium carboxylates and zirconium hydroxy carboxylates, such as hydrofluorozirconic acid, zirconium acetate, zirconium oxalate, ammonium zirconium glycolate, ammonium zirconium lactate, ammonium zirconium citrate, and mixtures thereof. Suitable compounds of titanium include, but are not limited to, fluorotitanic acid and its salts. A suitable compound of hafnium includes, but is not limited to, hafnium nitrate.

In certain embodiments, the amount of metal from the group IVB and/or group VB metal compound, in combination with the zirconyl compound, is included in the pretreatment composition in an amount of at least 10 ppm metal, such as at least 100 ppm metal, or, in some cases, at least 150 ppm metal (measured on elemental metal). In certain embodiments, the amount of metal from the group IVB and/or group VB metal compound, in combination with the zirconyl compound, is included in the pretreatment composition in an amount of no more than 5000 ppm metal, such as no more than 300 ppm metal, or, in some cases, no more than 250 ppm metal (measured on elemental metal). The amount of metal from the group IVB and/or group VB metal, in combination with the zirconyl compound, in the pretreatment composition can range between any combination of the recited values inclusive of the recited values.

In certain embodiments, the pretreatment composition also comprises an electropositive metal. As used herein, the term "electropositive metal" refers to metals that are more electropositive than the metal substrate to be treated with the pretreatment composition. This means that, for purposes of the present invention, the term "electropositive metal" encompasses metals that are less easily oxidized than the metal of the metal substrate. As will be appreciated by those skilled in the art, the tendency of a metal to be oxidized is called the oxidation potential, is expressed in volts, and is measured relative to a standard hydrogen electrode, which is arbitrarily assigned an oxidation potential of zero. The oxidation potential for several elements is set forth in the table below. An element is less easily oxidized than another element if it has a voltage value, E*, in the following table, that is greater than the element to which it is being compared.

| Element | Half-cell reaction | Voltage, E* |
|---|---|---|
| Potassium | $K^+ + e \rightarrow K$ | −2.93 |
| Calcium | $Ca^{2+} + 2e \rightarrow Ca$ | −2.87 |
| Sodium | $Na^+ + e \rightarrow Na$ | −2.71 |
| Magnesium | $Mg^{2+} + 2e \rightarrow Mg$ | −2.37 |
| Aluminum | $Al^{3+} + 3e \rightarrow Al$ | −1.66 |
| Zinc | $Zn^{2+} + 2e \rightarrow Zn$ | −0.76 |
| Iron | $Fe^{2+} + 2e \rightarrow Fe$ | −0.44 |
| Nickel | $Ni^{2+} + 2e \rightarrow Ni$ | −0.25 |
| Tin | $Sn^{2+} + 2e \rightarrow Sn$ | −0.14 |
| Lead | $Pb^{2+} + 2e \rightarrow Pb$ | −0.13 |
| Hydrogen | $2H^+ + 2e \rightarrow H_2$ | −0.00 |
| Copper | $Cu^{2+} + 2e \rightarrow Cu$ | 0.34 |
| Mercury | $Hg_2^{2+} + 2e \rightarrow 2Hg$ | 0.79 |
| Silver | $Ag^+ + e \rightarrow Ag$ | 0.80 |
| Gold | $Au^{3+} + 3e \rightarrow Au$ | 1.50 |

Thus, as will be apparent, when the metal substrate comprises one of the materials listed earlier, such as cold rolled steel, hot rolled steel, steel coated with zinc metal, zinc compounds, or zinc alloys, hot-dipped galvanized steel, galvanealed steel, steel plated with zinc alloy, aluminum alloys, aluminum plated steel, aluminum alloy plated steel, magnesium and magnesium alloys, suitable electropositive metals for deposition thereon in accordance with the present invention include, for example, nickel, copper, silver, and gold, as well mixtures thereof.

In certain embodiments, the source of electropositive metal in the pretreatment composition is a water soluble metal salt. In certain embodiments of the present invention, the water soluble metal salt is a water soluble copper compound. Specific examples of water soluble copper compounds, which are suitable for use in the present invention include, but are not limited to, copper cyanide, copper potassium cyanide, copper sulfate, copper nitrate, copper pyrophosphate, copper thiocyanate, disodium copper ethylenediaminetetraacetate tetrahydrate, copper bromide, copper oxide, copper hydroxide, copper chloride, copper fluoride, copper gluconate, copper citrate, copper lauroyl sarcosinate, copper formate, copper acetate, copper propionate, copper butyrate, copper lactate, copper oxalate, copper phytate, copper tartarate, copper malate, copper succinate, copper malonate, copper maleate, copper benzoate, copper salicylate, copper aspartate, copper glutamate, copper fumarate, copper glycerophosphate, sodium copper chlorophyllin, copper fluorosilicate, copper fluoroborate and copper iodate, as well as copper salts of carboxylic acids in the homologous series formic acid to decanoic acid, copper salts of polybasic acids in the series oxalic acid to suberic acid, and copper salts of hydroxycarboxylic acids, including glycolic, lactic, tartaric, malic and citric acids.

When copper ions supplied from such a water-soluble copper compound are precipitated as an impurity in the form of copper sulfate, copper oxide, etc., it may be preferable to add a complexing agent that suppresses the precipitation of copper ions, thus stabilizing them as a copper complex in the solution.

In certain embodiments, the copper compound is added as a copper complex salt such as $K_3Cu(CN)_4$ or Cu-EDTA, which can be present stably in the composition on its own, but it is also possible to form a copper complex that can be present stably in the composition by combining a complexing agent with a compound that is difficultly soluble on its own. Examples thereof include a copper cyanide complex formed by a combination of CuCN and KCN or a combination of CuSCN and KSCN or KCN, and a Cu-EDTA complex formed by a combination of $CuSO_4$ and EDTA.2Na.

With regard to the complexing agent, a compound that can form a complex with copper ions can be used; examples thereof include inorganic compounds, such as cyanide compounds and thiocyanate compounds, and polycarboxylic acids, and specific examples thereof include ethylenediaminetetraacetic acid, salts of ethylenediaminetetraacetic acid, such as dihydrogen disodium ethylenediaminetetraacetate dihydrate, aminocarboxylic acids, such as nitrilotriacetic acid and iminodiacetic acid, oxycarboxylic acids, such as citric acid and tartaric acid, succinic acid, oxalic acid, ethylenediaminetetramethylenephosphonic acid, and glycine.

In certain embodiments, the electropositive metal, such as copper, is included in the pretreatment compositions in an amount of at least 1 ppm, such as at least 5 ppm, or in some cases, at least 10 ppm of total metal (measured as elemental metal). In certain embodiments, the electropositive metal is included in such pretreatment compositions in an amount of no more than 500 ppm, such as no more than 100 ppm, or in some cases, no more than 50 ppm of total metal (measured as elemental metal). The amount of electropositive metal in the pretreatment composition can range between any combination of the recited values inclusive of the recited values.

The pretreatment composition may optionally contain other materials, such as nonionic surfactants and auxiliaries conventionally used in the art of pretreatment. In an aqueous medium, water dispersible organic solvents, for example, alcohols with up to about 8 carbon atoms, such as methanol, isopropanol, and the like, may be present; or glycol ethers such as the monoalkyl ethers of ethylene glycol, diethylene glycol, or propylene glycol, and the like. When present, water dispersible organic solvents are typically used in amounts up to about ten percent by volume, based on the total volume of aqueous medium.

Other optional materials include surfactants that function as defoamers or substrate wetting agents.

In certain embodiments, the pretreatment composition also comprises a reaction accelerator, such as nitrite ions, nitro-group containing compounds, hydroxylamine sulfate, persulfate ions, sulfite ions, hyposulfite ions, peroxides, iron (III) ions, citric acid iron compounds, bromate ions, perchlorinate ions, chlorate ions, chlorite ions as well as ascorbic acid, citric acid, tartaric acid, malonic acid, succinic acid and salts thereof. Specific examples of suitable materials and their amounts are described in United States Patent Application Publication No. 2004/0163736 A1 at [0032] to [0041], the cited portion of which being incorporated herein by reference.

In certain embodiments, the pretreatment composition also comprises a filler, such as a siliceous filler. Non-limiting examples of suitable fillers include silica, mica, montmorillonite, kaolinite, asbestos, talc, diatomaceous earth, vermiculite, natural and synthetic zeolites, cement, calcium silicate, aluminum silicate, sodium aluminum silicate, aluminum polysilicate, alumina silica gels, and glass particles. In addition to the siliceous fillers other finely divided particulate substantially water-insoluble fillers may also be employed. Examples of such optional fillers include carbon black, charcoal, graphite, titanium oxide, iron oxide, copper oxide, zinc oxide, antimony oxide, zirconia, magnesia, alumina, molybdenum disulfide, zinc sulfide, barium sulfate, strontium sulfate, calcium carbonate, and magnesium carbonate.

As indicated, in certain embodiments, the pretreatment composition is substantially or, in some cases, completely free of chromate and/or heavy metal phosphate. As used herein, the term "substantially free" when used in reference to the absence of chromate and/or heavy metal phosphate, such as zinc phosphate, in the pretreatment composition means that these substances are not present in the composition to such an extent that they cause a burden on the environment. That is, they are not substantially used and the formation of sludge, such as zinc phosphate, formed in the case of using a treating agent based on zinc phosphate, is eliminated. For the purposes of the present invention, a pretreatment composition having less than 1 weight percent of chromate and/or a heavy metal phosphate, wherein weight percent is based upon the total weight of the pretreatment composition, is considered "substantially free" of chromate and/or heavy metal phosphate.

In certain embodiments, the film coverage of the residue of the pretreatment coating composition generally ranges from 1 to 1000 milligrams per square meter ($mg/m^2$), such as 10 to 400 $mg/m^2$. The thickness of the pretreatment coating can vary, but it is generally very thin, often having a thickness of less than 1 micrometer, in some cases it is from 1 to 500 nanometers, and, in yet other cases, it is 10 to 300 nanometers.

Following contact with the pretreatment solution, the substrate may, if desired, be rinsed with water and dried.

In certain embodiments of the methods of the present invention, after the substrate is contacted with the pretreatment composition, it is then contacted with a coating composition comprising a film-forming resin. Any suitable technique may be used to contact the substrate with such a coating composition, including, for example, brushing, dipping, flow coating, spraying and the like. In certain embodiments, however, as described in more detail below, such contacting comprises an electrocoating step wherein an electrodepositable composition is deposited onto the metal substrate by electrodeposition.

As used herein, the term "film-forming resin" refers to resins that can form a self-supporting continuous film on at least a horizontal surface of a substrate upon removal of any diluents or carriers present in the composition or upon curing at ambient or elevated temperature. Conventional film-forming resins that may be used include, without limitation, those typically used in automotive OEM coating compositions, automotive refinish coating compositions, industrial coating compositions, architectural coating compositions, coil coating compositions, and aerospace coating compositions, among others.

In certain embodiments, the coating composition comprises a thermosetting film-forming resin. As used herein, the term "thermosetting" refers to resins that "set" irreversibly upon curing or crosslinking, wherein the polymer chains of the polymeric components are joined together by covalent bonds. This property is usually associated with a cross-linking reaction of the composition constituents often induced, for example, by heat or radiation. Curing or crosslinking reactions also may be carried out under ambient conditions. Once cured or crosslinked, a thermosetting resin will not melt upon the application of heat and is insoluble in solvents. In other embodiments, the coating composition comprises a thermoplastic film-forming resin. As used herein, the term "thermoplastic" refers to resins that comprise polymeric components that are not joined by covalent bonds and thereby can undergo liquid flow upon heating and are soluble in solvents.

As previously indicated, in certain embodiments, the substrate is contacted with a coating composition comprising a film-forming resin by an electrocoating step wherein an electrodepositable composition is deposited onto the metal substrate by electrodeposition. In the process of electrodeposition, the metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

Electrodeposition is usually carried out at a constant voltage in the range of from 1 volt to several thousand volts, typically between 50 and 500 volts. Current density is usually between 1.0 ampere and 15 amperes per square foot (10.8 to 161.5 amperes per square meter) and tends to decrease quickly during the electrodeposition process, indicating formation of a continuous self-insulating film.

The electrodepositable composition utilized in certain embodiments of the present invention often comprises a resinous phase dispersed in an aqueous medium wherein the resinous phase comprises: (a) an active hydrogen group-containing ionic electrodepositable resin, and (b) a curing agent having functional groups reactive with the active hydrogen groups of (a).

In certain embodiments, the electrodepositable compositions utilized in certain embodiments of the present invention contain, as a main film-forming polymer, an active hydrogen-containing ionic, often cationic, electrodepositable resin. A wide variety of electrodepositable film-forming resins are known and can be used in the present invention so long as the polymers are "water dispersible," i.e., adapted to be solubilized, dispersed or emulsified in water. The water dispersible polymer is ionic in nature, that is, the polymer will contain anionic functional groups to impart a negative charge or, as is often preferred, cationic functional groups to impart a positive charge.

Examples of film-forming resins suitable for use in anionic electrodepositable compositions are base-solubilized, carboxylic acid containing polymers, such as the reaction product or adduct of a drying oil or semi-drying fatty acid ester with a dicarboxylic acid or anhydride; and the reaction product of a fatty acid ester, unsaturated acid or anhydride and any additional unsaturated modifying materials which are further reacted with polyol. Also suitable are the at least partially neutralized interpolymers of hydroxyalkyl esters of unsaturated carboxylic acids, unsaturated carboxylic acid and at least one other ethylenically unsaturated monomer. Still another suitable electrodepositable film-forming resin comprises an alkyd-aminoplast vehicle, i.e., a vehicle containing an alkyd resin and an amine-aldehyde resin. Yet another anionic electrodepositable resin composition comprises mixed esters of a resinous polyol, such as is described in U.S. Pat. No. 3,749,657 at col. 9, lines 1 to 75 and col. 10, lines 1 to 13, the cited portion of which being incorporated herein by reference. Other acid functional polymers can also be used, such as phosphatized polyepoxide or phosphatized acrylic polymers as are known to those skilled in the art.

As aforementioned, it is often desirable that the active hydrogen-containing ionic electrodepositable resin (a) is cationic and capable of deposition on a cathode. Examples of such cationic film-forming resins include amine salt group-containing resins, such as the acid-solubilized reaction products of polyepoxides and primary or secondary amines, such as those described in U.S. Pat. Nos. 3,663,389; 3,984,299; 3,947,338; and 3,947,339. Often, these amine salt group-containing resins are used in combination with a blocked isocyanate curing agent. The isocyanate can be fully blocked, as described in U.S. Pat. No. 3,984,299, or the isocyanate can be partially blocked and reacted with the resin backbone, such as is described in U.S. Pat. No. 3,947,338. Also, one-component compositions as described in U.S. Pat. No. 4,134,866 and DE-OS No. 2,707,405 can be used as the film-forming resin. Besides the epoxy-amine reaction products, film-forming resins can also be selected from cationic acrylic resins, such as those described in U.S. Pat. Nos. 3,455,806 and 3,928,157.

Besides amine salt group-containing resins, quaternary ammonium salt group-containing resins can also be employed, such as those formed from reacting an organic polyepoxide with a tertiary amine salt as described in U.S. Pat. Nos. 3,962,165; 3,975,346; and 4,001,101. Examples of other cationic resins are ternary sulfonium salt group-containing resins and quaternary phosphonium salt-group containing resins, such as those described in U.S. Pat. Nos. 3,793,278 and 3,984,922, respectively. Also, film-forming resins which cure via transesterification, such as described in European Application No. 12463 can be used. Further, cationic compositions prepared from Mannich bases, such as described in U.S. Pat. No. 4,134,932, can be used.

In certain embodiments, the resins present in the electrodepositable composition are positively charged resins which contain primary and/or secondary amine groups, such as described in U.S. Pat. Nos. 3,663,389; 3,947,339; and 4,116,900. In U.S. Pat. No. 3,947,339, a polyketimine derivative of a polyamine, such as diethylenetriamine or triethylenetetraamine, is reacted with a polyepoxide. When the reaction product is neutralized with acid and dispersed in water, free primary amine groups are generated. Also, equivalent products are formed when polyepoxide is reacted with excess polyamines, such as diethylenetriamine and triethylenetetraamine, and the excess polyamine vacuum stripped from the reaction mixture, as described in U.S. Pat. Nos. 3,663,389 and 4,116,900.

In certain embodiments, the active hydrogen-containing ionic electrodepositable resin is present in the electrodepositable composition in an amount of 1 to 60 percent by weight, such as 5 to 25 percent by weight, based on total weight of the electrodeposition bath.

As indicated, the resinous phase of the electrodepositable composition often further comprises a curing agent adapted to react with the active hydrogen groups of the ionic electrodepositable resin. For example, both blocked organic polyisocyanate and aminoplast curing agents are suitable for use in the present invention, although blocked isocyanates are often preferred for cathodic electrodeposition.

Aminoplast resins, which are often the preferred curing agent for anionic electrodeposition, are the condensation products of amines or amides with aldehydes. Examples of suitable amine or amides are melamine, benzoguanamine, urea and similar compounds. Generally, the aldehyde employed is formaldehyde, although products can be made from other aldehydes, such as acetaldehyde and furfural. The condensation products contain methylol groups or similar alkylol groups depending on the particular aldehyde employed. Often, these methylol groups are etherified by reaction with an alcohol, such as a monohydric alcohol containing from 1 to 4 carbon atoms, such as methanol, ethanol, isopropanol, and n-butanol. Aminoplast resins are commercially available from American Cyanamid Co. under the trademark CYMEL and from Monsanto Chemical Co. under the trademark RESIMENE.

The aminoplast curing agents are often utilized in conjunction with the active hydrogen containing anionic electrodepositable resin in amounts ranging from 5 percent to 60 percent by weight, such as from 20 percent to 40 percent by weight, the percentages based on the total weight of the resin solids in the electrodepositable composition.

As indicated, blocked organic polyisocyanates are often used as the curing agent in cathodic electrodeposition compositions. The polyisocyanates can be fully blocked as described in U.S. Pat. No. 3,984,299 at col. 1, lines 1 to 68, col. 2, and col. 3, lines 1 to 15, or partially blocked and reacted with the polymer backbone as described in U.S. Pat. No. 3,947,338 at col. 2, lines 65 to 68, col. 3, and col. 4 lines 1 to 30, the cited portions of which being incorporated herein by reference. By "blocked" is meant that the isocyanate groups have been reacted with a compound so that the resultant blocked isocyanate group is stable to active hydrogens at ambient temperature but reactive with active hydrogens in the film forming polymer at elevated temperatures usually between 90° C. and 200° C.

Suitable polyisocyanates include aromatic and aliphatic polyisocyanates, including cycloaliphatic polyisocyanates and representative examples include diphenylmethane-4,4'-diisocyanate (MDI), 2,4- or 2,6-toluene diisocyanate (TDI), including mixtures thereof, p-phenylene diisocyanate, tetramethylene and hexamethylene diisocyanates, dicyclohexylmethane-4,4'-diisocyanate, isophorone diisocyanate, mixtures of phenylmethane-4,4'-diisocyanate and polymethylene polyphenylisocyanate. Higher polyisocyanates, such as triisocyanates can be used. An example would include triphenylmethane-4,4',4"-triisocyanate. Isocyanate ( )-prepolymers with polyols such as neopentyl glycol and trimethylolpropane and with polymeric polyols such as polycaprolactone diols and triols (NCO/OH equivalent ratio greater than 1) can also be used.

The polyisocyanate curing agents are typically utilized in conjunction with the active hydrogen containing cationic electrodepositable resin in amounts ranging from 5 percent to 60 percent by weight, such as from 20 percent to 50 percent by weight, the percentages based on the total weight of the resin solids of the electrodepositable composition.

In certain embodiments, the coating composition comprising a film-forming resin also comprises yttrium. In certain embodiments, yttrium is present in such compositions in an amount from 10 to 10,000 ppm, such as not more than 5,000 ppm, and, in some cases, not more than 1,000 ppm, of total yttrium (measured as elemental yttrium).

Both soluble and insoluble yttrium compounds may serve as the source of yttrium. Examples of yttrium sources suitable for use in lead-free electrodepositable coating compositions are soluble organic and inorganic yttrium salts such as yttrium acetate, yttrium chloride, yttrium formate, yttrium carbonate, yttrium sulfamate, yttrium lactate and yttrium nitrate. When the yttrium is to be added to an electrocoat bath as an aqueous solution, yttrium nitrate, a readily available yttrium compound, is a preferred yttrium source. Other yttrium compounds suitable for use in electrodepositable compositions are organic and inorganic yttrium compounds such as yttrium oxide, yttrium bromide, yttrium hydroxide, yttrium molybdate, yttrium sulfate, yttrium silicate, and yttrium oxalate. Organoyttrium complexes and yttrium metal can also be used. When the yttrium is to be incorporated into an electrocoat bath as a component in the pigment paste, yttrium oxide is often the preferred source of yttrium.

The electrodepositable compositions described herein are in the form of an aqueous dispersion. The term "dispersion" is believed to be a two-phase transparent, translucent or opaque resinous system in which the resin is in the dispersed phase and the water is in the continuous phase. The average particle size of the resinous phase is generally less than 1.0 and usually less than 0.5 microns, often less than 0.15 micron.

The concentration of the resinous phase in the aqueous medium is often at least 1 percent by weight, such as from 2 to 60 percent by weight, based on total weight of the aqueous dispersion. When such compositions are in the form of resin concentrates, they generally have a resin solids content of 20 to 60 percent by weight based on weight of the aqueous dispersion.

The electrodepositable compositions described herein are often supplied as two components: (1) a clear resin feed, which includes generally the active hydrogen-containing ionic electrodepositable resin, i.e., the main film-forming polymer, the curing agent, and any additional water-dispersible, non-pigmented components; and (2) a pigment paste, which generally includes one or more pigments, a water-dispersible grind resin which can be the same or different from the main-film forming polymer, and, optionally, additives such as wetting or dispersing aids. Electrodeposition bath components (1) and (2) are dispersed in an aqueous medium which comprises water and, usually, coalescing solvents.

As aforementioned, besides water, the aqueous medium may contain a coalescing solvent. Useful coalescing solvents are often hydrocarbons, alcohols, esters, ethers and ketones. The preferred coalescing solvents are often alcohols, polyols and ketones. Specific coalescing solvents include isopropanol, butanol, 2-ethylhexanol, isophorone, 2-methoxypentanone, ethylene and propylene glycol and the monoethyl monobutyl and monohexyl ethers of ethylene glycol. The amount of coalescing solvent is generally between 0.01 and 25 percent, such as from 0.05 to 5 percent by weight based on total weight of the aqueous medium.

In addition, a colorant and, if desired, various additives such as surfactants, wetting agents or catalyst can be included in the coating composition comprising a film-forming resin. As used herein, the term "colorant" means any substance that imparts color and/or other opacity and/or other visual effect to the composition. The colorant can be added to the composition in any suitable form, such as discrete particles, dispersions, solutions and/or flakes. A single colorant or a mixture of two or more colorants can be used.

Example colorants include pigments, dyes and tints, such as those used in the paint industry and/or listed in the Dry Color Manufacturers Association (DCMA), as well as special effect compositions. A colorant may include, for example, a finely divided solid powder that is insoluble but wettable under the conditions of use. A colorant can be organic or inorganic and can be agglomerated or non-agglomerated. Colorants can be incorporated by use of a grind vehicle, such as an acrylic grind vehicle, the use of which will be familiar to one skilled in the art.

Example pigments and/or pigment compositions include, but are not limited to, carbazole dioxazine crude pigment, azo, monoazo, disazo, naphthol AS, salt type (lakes), benzimidazolone, condensation, metal complex, isoindolinone, isoindoline and polycyclic phthalocyanine, quinacridone, perylene, perinone, diketopyrrolo pyrrole, thioindigo, anthraquinone, indanthrone, anthrapyrimidine, flavanthrone, pyranthrone, anthanthrone, dioxazine, triarylcarbonium, quinophthalone pigments, diketo pyrrolo pyrrole red ("DPPBO red"), titanium dioxide, carbon black and mixtures thereof. The terms "pigment" and "colored filler" can be used interchangeably.

Example dyes include, but are not limited to, those that are solvent and/or aqueous based such as phthalo green or blue, iron oxide, bismuth vanadate, anthraquinone, perylene, aluminum and quinacridone.

Example tints include, but are not limited to, pigments dispersed in water-based or water miscible carriers such as AQUA-CHEM 896 commercially available from Degussa, Inc., CHARISMA COLORANTS and MAXITONER INDUSTRIAL COLORANTS commercially available from Accurate Dispersions division of Eastman Chemical, Inc.

As noted above, the colorant can be in the form of a dispersion including, but not limited to, a nanoparticle dispersion. Nanoparticle dispersions can include one or more highly dispersed nanoparticle colorants and/or colorant particles that produce a desired visible color and/or opacity and/or visual effect. Nanoparticle dispersions can include colorants such as pigments or dyes having a particle size of less than 150 nm, such as less than 70 nm, or less than 30 nm. Nanoparticles can be produced by milling stock organic or inorganic pigments with grinding media having a particle size of less than 0.5 mm Example nanoparticle dispersions and methods for making them are identified in U.S. Pat. No. 6,875,800 B2, which is incorporated herein by reference. Nanoparticle dispersions can also be produced by crystallization, precipitation, gas phase condensation, and chemical attrition (i.e., partial dissolution). In order to minimize re-agglomeration of nanoparticles within the coating, a dispersion of resin-coated nanoparticles can be used. As used herein, a "dispersion of resin-coated nanoparticles" refers to a continuous phase in which is dispersed discreet "composite microparticles" that comprise a nanoparticle and a resin coating on the nanoparticle. Example dispersions of resin-coated nanoparticles and methods for making them are identified in United States Patent Application Publication 2005-0287348 A1, filed Jun. 24, 2004, U.S. Provisional Application No. 60/482,167 filed Jun. 24, 2003, and U.S. patent application Ser. No. 11/337,062, filed Jan. 20, 2006, which is also incorporated herein by reference.

Example special effect compositions that may be used include pigments and/or compositions that produce one or more appearance effects such as reflectance, pearlescence, metallic sheen, phosphorescence, fluorescence, photochromism, photosensitivity, thermochromism, goniochromism and/or color-change. Additional special effect compositions can provide other perceptible properties, such as opacity or texture. In certain embodiments, special effect compositions can produce a color shift, such that the color of the coating changes when the coating is viewed at different angles. Example color effect compositions are identified in U.S. Pat. No. 6,894,086, incorporated herein by reference. Additional color effect compositions can include transparent coated mica and/or synthetic mica, coated silica, coated alumina, a transparent liquid crystal pigment, a liquid crystal coating, and/or any composition wherein interference results from a refractive index differential within the material and not because of the refractive index differential between the surface of the material and the air.

In certain embodiments, a photosensitive composition and/or photochromic composition, which reversibly alters its color when exposed to one or more light sources, can be used in the present invention. Photochromic and/or photosensitive compositions can be activated by exposure to radiation of a specified wavelength. When the composition becomes excited, the molecular structure is changed and the altered structure exhibits a new color that is different from the original color of the composition. When the exposure to radiation is removed, the photochromic and/or photosensitive composition can return to a state of rest, in which the original color of the composition returns. In certain embodiments, the photochromic and/or photosensitive composition can be colorless in a non-excited state and exhibit a color in an excited state. Full color-change can appear within milliseconds to several minutes, such as from 20 seconds to 60 seconds. Example photochromic and/or photosensitive compositions include photochromic dyes.

In certain embodiments, the photosensitive composition and/or photochromic composition can be associated with and/or at least partially bound to, such as by covalent bonding, a polymer and/or polymeric materials of a polymerizable component. In contrast to some coatings in which the photosensitive composition may migrate out of the coating and crystallize into the substrate, the photosensitive composition and/or photochromic composition associated with and/or at least partially bound to a polymer and/or polymerizable component in accordance with certain embodiments of the present invention, have minimal migration out of the coating. Example photosensitive compositions and/or photochromic compositions and methods for making them are identified in U.S. application Ser. No. 10/892,919 filed Jul. 16, 2004, incorporated herein by reference.

In general, the colorant can be present in the coating composition in any amount sufficient to impart the desired visual and/or color effect. The colorant may comprise from 1 to 65 weight percent, such as from 3 to 40 weight percent or 5 to 35 weight percent, with weight percent based on the total weight of the compositions.

After deposition, the coating is often heated to cure the deposited composition. The heating or curing operation is often carried out at a temperature in the range of from 120 to 250° C., such as from 120 to 190° C. for a period of time ranging from 10 to 60 minutes. In certain embodiments, the thickness of the resultant film is from 10 to 50 microns.

As will be appreciated by the foregoing description, the present invention is directed to methods for coating a metal substrate comprising: (a) contacting the substrate with a pretreatment composition, and then (b) depositing a coating on the substrate that is formed from a composition comprising a film-forming resin. These methods of the present invention do not include depositing a zinc phosphate or chromate-containing coating on the substrate.

The pretreatment compositions according to certain embodiments of the present invention, based on zirconyl compounds, contain little or no free fluoride. As a result, anticorrosive compounds, such as the rare earth elements described herein, that are insoluble when free fluoride is present in pretreatment are now soluble in the pretreatment compositions of the present invention. Coatings including zirconyl compounds and these rare earth elements display surface morphology that is distinctly different from pretreatment composition coating based on zirconium and containing free fluoride. In addition, as is confirmed in the examples below, the corrosion resistance performed at least as good, or better, than pretreatment compositions based on zirconium compounds having free fluoride and not containing a rare earth metal. As defined herein, a pretreatment composition containing "little or no free fluoride" is a pretreatment composition having no more than 1 ppm of free fluoride (based on elemental fluoride).

For certain substrates, such as aluminum containing substrates, in certain embodiments, a small amount of free fluoride may be included in the pretreatment composition to etch the surface of the aluminum containing substrate. In these certain embodiments, however, the relative amount of free fluoride is such that limited complexing with the rare earth elements, and hence limited insolubility of the resultant rare earth metal complex, occurs. As defined herein, a pretreatment composition containing "a small amount of free fluoride" is a pretreatment composition having between 2 ppm and 30 ppm, such as 25 ppm, of free fluoride (based on elemental fluoride).

As has been indicated throughout the foregoing description, the methods and coated substrates of the present invention, in certain embodiments, do not include the deposition of a heavy metal phosphate, such as zinc phosphate, or a chromate. As a result, the environmental drawbacks associated with such materials are avoided. Nevertheless, the methods of the present invention have been shown to provide coated substrates that are, in at least some cases, resistant to corrosion at a level comparable to, in some cases even superior to, methods wherein such materials are used. This is a surprising and unexpected discovery of the present invention and satisfies a long felt need in the art. In addition, the methods of the present invention have been shown to avoid the discoloration of subsequently applied coatings, such as certain non-black electrodeposited coatings.

Illustrating the invention are the following examples that are not to be considered as limiting the invention to their details. All parts and percentages in the examples, as well as throughout the specification, are by weight unless otherwise indicated.

EXAMPLE 1

The following materials and coating compositions were prepared and evaluated using Tests 1 and 2 as follows:

Cleaner 1: Chemkleen 166 HP/171ALF, alkaline cleaner

Cleaner 2: Chemkleen 2010LP/181ALP, alkaline cleaner

Pretreatment 1: CHEMFOS 700(CF700AW)/CHEMSEAL 59(CS59), immersion applied tricationic Zn phosphate and sealer, commercially available from PPG Industries, Inc.

Pretreatment 2: Zirconyl nitrate based pretreatment

The zirconium pretreatment solution was prepared by diluting zirconyl nitrate with water to a zirconium concentration of 200 ppm (as zirconium) and adjusting the pH to 2.9 with Chemfil® buffer. After pretreatment in the zirconium pretreatment solution, the panels were rinsed thoroughly with deionized water and then dried with a warm air blowoff.

Pretreatment 3: Zirconyl nitrate based pretreatment with Cu

The zirconium pretreatment solution was prepared by diluting zirconyl nitrate with water to a zirconium concentration of 200 ppm (as zirconium), adding 20 ppm of copper nitrate (as copper), and adjusting the pH to 2.9 with Chemfil® buffer. After pretreatment in the zirconium pretreatment solution, the panels were rinsed thoroughly with deionized water and then dried with a warm air blowoff.

Pretreatment 4: Zirconyl nitrate based pretreatment with Cerium

The zirconium pretreatment solution was prepared by diluting zirconyl nitrate with water to a zirconium concentration of 200 ppm (as zirconium), adding 50 ppm of cerium chloride heptahydrate (as cerium), and adjusting the pH to 2.9 with Chemfil® buffer. After pretreatment in the zirconium pretreatment solution, the panels were rinsed thoroughly with deionized water and then dried with a warm air blowoff.

Pretreatment 5: Zirconyl nitrate based pretreatment with Praseodynium

The zirconium pretreatment solution was prepared by diluting zirconyl nitrate with water to a zirconium concentration of 200 ppm (as zirconium), adding 50 ppm of praseodymium nitrate hexahydrate (as praseodymium), and adjusting the pH to 2.9 with Chemfil® buffer. After pretreatment in the zirconium pretreatment solution, the panels were rinsed thoroughly with deionized water and then dried with a warm air blowoff.

Pretreatment 6: Zirconyl nitrate based pretreatment with added fluoride

The zirconium pretreatment solution was prepared by diluting zirconyl nitrate with water to a zirconium concentration of 200 ppm (as zirconium), adding 0.10 M ammonium bifluoride so that a fluoride ion selective electrode (9609BNWP Thermo Scientific) measured a free fluoride concentration of 25 ppm, and adjusting the pH to 2.9 with Chemfil® buffer. After pretreatment in the zirconium pretreatment solution, the panels were rinsed thoroughly with deionized water and then dried with a warm air blowoff.

Pretreatment 7: Zirconyl nitrate based pretreatment with Cu and added fluoride

The zirconium pretreatment solution was prepared by diluting zirconyl nitrate with water to a zirconium concentration of 200 ppm (as zirconium), adding 0.10 M ammonium bifluoride so that a fluoride ion selective electrode (9609BNWP Thermo Scientific) measured a free fluoride concentration of 25 ppm, adding 20 ppm of copper nitrate (as copper), and adjusting the pH to 2.9 with Chemfil® buffer. After pretreatment in the zirconium pretreatment solution, the panels were rinsed thoroughly with deionized water and then dried with a warm air blowoff.

Pretreatment 8: Zirconyl nitrate based pretreatment with Yttrium

The zirconium pretreatment solution was prepared by diluting zirconyl nitrate with water to a zirconium concentration of 200 ppm (as zirconium), adding 100 ppm of yttrium nitrate (as yttrium), and adjusting the pH to 2.9 with Chemfil® buffer. After pretreatment in the zirconium pretreatment solution, the panels were rinsed thoroughly with deionized water and then dried with a warm air blowoff.

Pretreatment 9: Zirconyl nitrate based pretreatment with hexafluorozirconic acid The zirconium pretreatment solution was prepared by diluting zirconyl nitrate with water to a zirconium concentration of 100 ppm (as zirconium), adding 100 ppm hexafluorozirconic acid, and adjusting the pH to 4.4 with Chemfil® buffer. After pretreatment in the zirconium pretreatment solution, the panels were rinsed thoroughly with deionized water and then dried with a warm air blowoff.

Paint 1: ED6060CZ, a cathodic electrocoat available from PPG Industries.

Paint 2: Amine catalyzed epoxy per military specification Mil-P-53022.

Test 1: 20 or 40 cycles of GM-9511P.

Test 2: 40 cycles of GM-9540P.

The coating systems were cleaned using Cleaner 1 or 2, rinsed with deionized water, and pretreated (spray or immersion) for 120 seconds at 27° C. Panels were then rinsed with deionized water and dried by for 5 minutes at 55° C. using forced air.

The example coating (Paint 1) composition was applied at 0.0008-0.0010 inches and cured for 25 minutes at 175° C. in an electric oven.

Example 1

Pretreatment 1 was evaluated against pretreatment 2-8 for resistance to Test 1 and 2. Cold-rolled panels (ACT Panels) were cleaned using Cleaner 1, rinsed with deionized water, and pretreated (spray or immersion) for 120 seconds at 27° C. Panels were then rinsed with deionized water and dried by for 5 minutes at 55° C. using forced air.

Pretreatments were evaluated by coating them with electrocoat, curing the paint film, then subjecting them to 40 cycle hours per GM-9511P (Test 1) and per GM-9540P (Test 2). Panels were electrocoated using Paint 1 composition 0.0008-0.0010 inch dry film thickness and cured for 25 minutes at 175° C. in an electric oven.

Samples were then scribed vertically and subjected to Test 1 and Test 2 for 40 cycles. The corrosion performance of the various pretreatment compositions after these tests is summarized in Table 1.

TABLE 1

Corrosion Performance

| | 40 cycle GM9511P (Test 1), mm | 40 cycles GM9540P (Test 2), mm |
|---|---|---|
| Pretreatment 1 | 6.3 | 4.3 |
| Pretreatment 2 | 7.2 | 6.5 |
| Pretreatment 3 | 10.6 | 4.0 |
| Pretreatment 4 | 8.6 | 5.9 |
| Pretreatment 5 | 8.6 | 5.9 |
| Pretreatment 6 | 7.0 | 6.5 |
| Pretreatment 7 | 9.4 | 4.6 |
| Pretreatment 8 | 9.2 | 4.8 |

Example 2

Pretreatment 1 was evaluated against Pretreatments 2, 4, 6, and 9 for resistance to Test 1 and 2. Cold-rolled panels (ACT Panels) were cleaned using Cleaner 1, rinsed with deionized water, and pretreated (spray or immersion) for 120 seconds at 27° C. Panels were then rinsed with deionized water and dried by for 5 minutes at 55° C. using forced air.

Pretreatments were evaluated by coating them with electrocoat, curing the paint film, then subjecting them to 20 cycle hours GM-9511P (Test 1) and GM-9540P (Test 2). Panels were coated with Paint 2 composition at 0.0009-0.0011 inch dry film thickness and allowed to cure at ambient conditions for 7 days.

Samples were then scribed vertically and placed in Test 1 for 20 cycles.

TABLE 2

| Corrosion Performance | |
|---|---|
| | 20 cycles GM9511P (Test 1), mm |
| Pretreatment 1 | 2.0 |
| Pretreatment 2 | 1.6 |
| Pretreatment 4 | 2.4 |
| Pretreatment 6 | 6.2 |
| Pretreatment 9 | 4.4 |

Inspection of the data tables reveals performance of pretreatments derived free of F—, and from a zirconyl complex, perform similar to Zn phosphate based pretreatments when electrocoated. The data tables also indicate that performance of pretreatments derived free of F—, and from a zirconyl complex perform, similar to Zn phosphate based pretreatments when painted with amine catalyzed epoxy.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

We claim:

1. A pretreatment composition for treating a metal substrate comprising: (a) a soluble rare earth metal; (b) a zirconyl compound; and (c) an electropositive metal, wherein the pretreatment composition contains no free fluoride, wherein the pretreatment composition is free of phosphate ions, wherein a ratio of zirconium from said zirconyl compound to said rare earth metal in the pretreatment composition is 200/1 and 1/1, and wherein upon contact with the metal substrate, the pretreatment composition reacts with and chemically alters a surface of the metal substrate and binds to the surface of the metal substrate to form a protective layer.

2. The pretreatment composition of claim 1, wherein said zirconyl compound (b) comprises zirconyl nitrate, zirconyl acetate, zirconyl carbonate, protonated zirconium basic carbonate, zirconyl sulfate, zirconyl chloride, zirconyl iodide, zirconyl bromide or a mixture thereof.

3. The pretreatment composition of claim 1 further comprising: (d) a group IVB and/or group VB metal.

4. The pretreatment composition of claim 3, wherein the amount of metal from said zirconyl compound and from said group IVB and/or group VB metal in the pretreatment composition comprises from 10 ppm to 5000 ppm.

5. The pretreatment composition of claim 1, wherein said rare earth metal (a) comprises yttrium, praseodymium, cerium, or mixtures thereof.

6. The pretreatment composition of claim 1, wherein a source of said rare earth metal (a) comprises a rare earth metal compound.

7. The pretreatment composition of claim 6, wherein said rare earth metal compound comprises a compound of yttrium, cerium, praseodymium, or a mixture thereof.

8. The pretreatment composition of claim 1, wherein the amount of zirconium from said zirconyl compound in the pretreatment composition comprises from 10 ppm to 5000 ppm.

9. The pretreatment composition of claim 1, wherein said electropositive metal is more electropositive than the metal substrate.

10. The pretreatment composition of claim 1, wherein the pretreatment composition is substantially free of heavy metal phosphate.

11. The pretreatment composition of claim 1, wherein the pretreatment composition is completely free of heavy metal phosphate.

12. A method for treating a metal substrate comprising:

(a) contacting the metal substrate with a pretreatment composition comprising a soluble rare earth metal, a zirconyl compound, and an electropositive metal, wherein the pretreatment composition contains no free fluoride, wherein the pretreatment composition is free of phosphate ions, wherein a ratio of zirconium from said zirconyl compound to said rare earth metal in the pretreatment composition is 200/1 and 1/1, and wherein upon contact with the metal substrate, the pretreatment composition reacts with and chemically alters a surface of the metal substrate and binds to the surface of the metal substrate to form a protective layer.

13. The method according to claim 12, wherein said pretreatment composition is contacted to the metal substrate without the prior application of an electropositive metal.

14. The method of claim 12, wherein said pretreatment composition further comprises a group IVB and/or group VB metal.

15. The method of claim 12 further comprising electrophoretically depositing a coating composition onto the metal substrate after step (a).

* * * * *